United States Patent [19]

Yanagida et al.

[11] 3,954,575

[45] May 4, 1976

[54] ZINC ELECTROPLATING

[75] Inventors: Kazuo Yanagida, Kasukabe; Tethuzi Aoki, Chiba; Akio Takahashi, Kisarazu; Toshio Igarashi, Tokyo, all of Japan

[73] Assignee: Dipsol Chemicals Co., Ltd., Tokyo, Japan

[22] Filed: Nov. 11, 1974

[21] Appl. No.: 522,762

Related U.S. Application Data

[63] Continuation-in-part of Ser. No. 413,673, Nov. 7, 1973, abandoned.

[30] Foreign Application Priority Data

Nov. 10, 1972 Japan ..... 47-112014

[52] U.S. Cl. ..... 204/55 R; 204/55 Y; 260/2 EP

[51] Int. Cl.[2] ..... C25D 3/22; C25D 3/24

[58] Field of Search ..... 204/55 R, 55 Y, 43 Z, 204/114

[56] References Cited

UNITED STATES PATENTS

| | | | |
|---|---|---|---|
| 3,227,638 | 1/1966 | Burnson | 204/55 Y X |
| 3,393,135 | 7/1968 | Rosenberg | 204/55 Y |
| 3,655,534 | 4/1972 | Kampe | 204/55 R |
| 3,803,008 | 4/1974 | Rosenberg | 204/55 Y |
| 3,823,076 | 7/1974 | Rushmere | 204/55 R |
| 3,824,158 | 7/1974 | Rosenberg | 204/55 R |
| 3,838,026 | 9/1974 | Koch | 204/55 R |
| 3,853,718 | 12/1974 | Creutz | 204/55 R |
| 3,869,358 | 3/1975 | Nobel et al. | 204/55 Y |

*Primary Examiner*—G. L. Kaplan
*Attorney, Agent, or Firm*—Oblon, Fisher, Spivak, McClelland & Maier

[57] ABSTRACT

A method for depositing bright zinc from zinc electrodeposition baths in which an aqueous solution of a low molecular weight polymer prepared by the reaction of at least one epihalohydrin with at least one nitrogen heterocyclic compound is added to the zinc electroplating bath.

6 Claims, No Drawings

ZINC ELECTROPLATING

CROSS-REFERENCE TO RELATED APPLICATIONS

This application is a continuation-in-part application of Ser. No. 413,673, filed Nov. 7, 1973, now abandoned.

BACKGROUND OF THE INVENTION

1. Field of the Invention

This invention relates to a method for brightening the electrodeposits of zinc from zinc electroplating baths such as the cyanide, zincate or chloride baths.

2. Description of the Prior Art

It is well-known that bright zinc electroplated coatings cannot be obtained without using a zinc electroplating bath which contains a brightener. Consequently, various types of brightener additives for zinc electrodepositing processes have been widely investigated. Included among those brighteners are aliphatic aldehydes, aryl aldehydes, heterocyclic aldehydes, derivatives or organic compounds containing a nitrogen or a sulfur atom and the reaction products of specific aliphatic amines with compounds containing alkyl or aryl radicals.

The brightener additives which have been developed in the prior art are satisfactory only for use in a specific electroplating bath such as cyanide baths, but are not presently satisfactory for use in other baths such as zincate baths. None of the brightener additives known presently are satisfactory for use in two or more types of electroplating baths.

A need therefore continues to exist for a method of brightening zinc electrodepositions which is useful in more than one type of zinc electroplating baths.

SUMMARY OF THE INVENTION

Accordingly, one object of the present invention is to provide a method for brightening by employing an additive which is well suited for use in various types of zinc electroplating baths.

Briefly, this object and other objects of the invention as hereinafter will become more readily apparent can be attained by providing a brightener additive for zinc electroplating baths which comprises a water-soluble polymer prepared by reacting at least one epihalohydrin with at least one nitrogen heterocyclic compound such as the compounds of imidazole, and pyrrole.

DESCRIPTION OF THE PREFERRED EMBODIMENTS

The nitrogen heterocyclic starting materials for the preparation of the water soluble polymer brighteners of this invention include imidazole, pyrrole, derivatives thereof and other nitrogen-heterocyclic compounds wherein a ring hydrogen atom and/or the hydrogen atom of the imino radical are substituted with an OH, alkyl, amino or acetyl radical. Suitable specific starting nitrogen heterocyclic compounds include 1-methylimidazole, 2-methylimidazole, 1,4-dimethylimidazole, 4-hydroxy-2-aminoimidazole, 5-ethyl-4-hydroxyimidazole, 2,5-dimethylpyrrole, 1-ethylpyrrole, 1-acetylpyrrole and 1-methylpyrrole.

The water soluble polymer brightener additives can be prepared by adding at least one epihalohydrin to at least one nitrogen heterocyclic compound in quantities ranging from ½–3 moles per mole of nitrogen heterocyclic compound, and then reacting the material in the presence of water for about 2.5 hours at 50°–90°C. Suitable epihalohydrins include epichlorohydrin and epibromohydrin.

The brightener additives prepared by this procedure are low molecular weight water-soluble polymers and their precise structures are presently under investigation. The brightener additives once prepared are diluted several times with water and then added to the electroplating bath in ratios 0.5–10 cc/l.

The product brighteners of this invention once electrodeposited with the plated zinc exhibit a considerably enhanced brightening effect and a range of brightness superior to the conventional additives used in zinc electroplating baths.

The brightener additives of the prior art hereinafter disclosed can be added to the brightener additives of this invention, if desired.

Having generally described this invention, a further understanding can be obtained by reference to certain specific examples which are provided herein for purposes of illustration only and are not intended to be limiting unless otherwise specified. The Examples show the preparation of some of the brightener additives of the present invention.

EXAMPLE 1

A 30g quantity of 2-methylimidazole and 140 g of water were added to a three necked flask of 300 cc equipped with a thermometer, a condenser and a separatory funnel. The solution was stirred and the solid material dissolved. The solution was warmed to 50°C, and 60g of epichlorohydrin was added dropwise over 30 minutes to the flask while the stirred solution was maintained at 50°–80°C. The reaction was completed by stirring the solution for 2 hours at 80°–85°C after the addition of the epichlorohydrin.

EXAMPLE 2

A 20g quantity of 4-hydroxy-2-aminoimidazole and 80g of water were added to a 300 cc three necked flask which was used in Example 1. The mixture was dissolved with stirring. The solution was warmed to 70°C, and 30g of epichlorohydrin was added dropwise while stirring over 30 minutes while maintaining the solution at 70°C. The reaction was completed by stirring the solution for 5 hours at 70°C after addition of the epichlorohydrin.

EXAMPLE 3

A 16g quantity of pyrrole and 60g of water were added to a 200 cc three necked flask equipped with a thermometer, a condenser and a separatory funnel, and the mixture was dissolved completely with stirring.

The stirred solution was warmed to 70°C, and 30g of epichlorohydrin was added dropwise over 30 minutes. The reaction was completed by stirring the solution for 2 hours at 80°C after the addition of the epichlorohydrin.

EXAMPLE 4

A 10g quantity of 2,5-dimethylpyrrole, 5g of piperidine and then 60g of water were added to the 300 cc flask used in Example 1 and the mixture was dissolved with stirring. The solution was warmed to 50°C and then 40g of epichlorohydrin was added dropwise over 60 minutes while the stirred solution was at a temperature of 70°C. The reaction was completed by stirring the solution for 4 hours at 85°C after the addition of the epichlorohydrin.

EXAMPLE 5

A 35g quantity of pyrrolidine, 5g of 2-methylimidazole and then 80g of water were added to the 300 cc three necked flask of Example 1, and the mixture was dissolved completely with stirring. The stirred solution was then warmed to 60°C and 60g of epichlorohydrin was added dropwise over 1 hour. After the addition of the epichlorohydrin, the reaction was completed by stirring the solution for 3 hours at 90°C.

EXAMPLE 6

A 5g amount of imidazole, 7g of pyrrolidine, 4g of 1,4-ethylenepiperazine and then 80g of water were added to a 300cc four-necked flask, and the mixture was dissolved with stirring. The solution was warmed to 70°C and 25g of epichlorohydrin was added dropwise over 40 minutes while the stirred solution was held at 70°C. The reaction was completed by stirring the solution for 3 hours at 90°C after the addition of the epichlorohydrin.

EXAMPLE 7

A 12g amount of N,N-dimethylpiperazine, 7g of 1,4-dimethylimidazole 5g of sodium hydroxide and then 80g of water were added to the 300 cc three necked flask of Example 1 and the mixture was dissolved with stirring. The solution was warmed to 60°C and 40g of epichlorohydrin was added dropwise over 60 minutes while the stirred solution was held at 60°C. The reaction was completed by stirring the solution for 2 hours at 85°C after the addition of the chlorohydrin.

The brightener additive solutions prepared in each Example Nos. 1–7 were diluted to 200g with water, and the diluted solutions were added to the following electroplating baths in amounts of 4g of brightener solution per electroplating bath.

| Composition | | Kind of Bath | | | |
|---|---|---|---|---|---|
| | | Zn | Cl | M-C | L-C |
| Zinc metal | g/l | 10 | — | 20 | 10 |
| NaOH | g/l | 120 | — | 80 | 80 |
| NaCN | g/l | — | — | 40 | 120 |
| Metal/NaCN | (weight ratio) | — | — | 2.0 | 1.25 |
| $ZnCl_2$ | g/l | — | 16 | — | — |
| $NH_4Cl$ | g/l | — | 180 | — | — |

Note:
Zn: Zincate bath, Cl: Chloride bath
M-C: Bath of medium cyanide concentration
L-C: Bath of low cyanide concentration The electroplating of zinc on steel was performed by passing an electric current (current density 3 A/dm) at a bath temperature of 25°C. For each bath used containing one of the brighteners of the invention, a bright zinc layer was electrodeposited on the steel.

When 0.1g/l of a prior art brightener additive, anise aldehyde was added to each of the zinc electrodepositing baths containing the brighteners of Examples 1–7, and when steel was electroplated with each bath under the same conditions described above, it was found that a brighter zinc layer was electrodeposited on the steel in each instance then was obtained for the steel electroplated with zinc containing the brighteners of the invention alone.

Having now fully described this invention, it will be apparent to one of ordinary skill in the art that many changes and modifications can be made thereto without departing from the spirit or scope of the invention as set forth herein.

What is claimed as new and intended to be covered by Letters Patent is:

1. A method for the electrodeposition of bright zinc which comprises electrodepositing zinc from an aqueous zinc electrodepositing bath comprising an aqueous solution containing a source of zinc ions and an effective amount, sufficient to yield a bright zinc electrode deposit, of a bath-soluble reaction product prepared by the reaction of at least one epihalohydrin with at least one heterocyclic compound selected from the group consisting of imidazole compounds and pyrrole compounds, wherein 0.5 to 3 moles of said epihalohydrin is reacted per mole of said nitrogen heterocyclic compound at 50°–90°C.

2. The method of claim 1, wherein said imidazole compound comprises at least one imidazole compound substituted with a radical selected from the group consisting of OH, alkyl, amino and acetyl.

3. The method of claim 2, wherein said imidazole compound is selected from the group consisting of imidazole, 1-methylimidazole, 2-methylimidazole, 1,4-dimethylimidazole, 4-hydroxy-2-amino imidazole and 5-ethyl-4-hydroxy imidazole.

4. The method of claim 1, wherein said pyrrole compound comprises at least one pyrrole compound substituted with a radical selected from the group consisting of OH, alkyl, amino and acetyl.

5. The method of claim 1, wherein said pyrrole compound is selected from the group consisting of pyrrole, 2,5-dimethylpyrrole, 1-ethylpyrrole, 1-acetylpyrrole, and 1-methylpyrrole.

6. The method of claim 1, wherein the epihalohydrin is selected from the group consisting of epichlorohydrin and epibromohydrin.

* * * * *